US005299430A

United States Patent [19]

Tsuchiyama

[11] Patent Number: 5,299,430

[45] Date of Patent: Apr. 5, 1994

[54] AIR CONDITIONER

[75] Inventor: Yuji Tsuchiyama, Nittamachi, Japan

[73] Assignee: Sanyo Electric Co., Ltd., Osaka, Japan

[21] Appl. No.: 26,531

[22] Filed: Mar. 4, 1993

[30] Foreign Application Priority Data

Mar. 13, 1992 [JP] Japan ..... 4-055215
Jun. 4, 1992 [JP] Japan ..... 4-144326

[51] Int. Cl.[5] ..... F25D 17/00

[52] U.S. Cl. ..... 62/180; 62/213; 62/229; 236/51

[58] Field of Search ..... 236/51, 78 B; 62/213, 62/229, 180

[56] References Cited

U.S. PATENT DOCUMENTS

| | | | |
|---|---|---|---|
| 4,682,648 | 7/1987 | Fried | 236/51 X |
| 4,891,953 | 1/1990 | Isono | 236/78 B |
| 4,936,104 | 6/1990 | Hicke | 62/229 |
| 5,012,973 | 5/1991 | Dick et al. | 236/51 X |

*Primary Examiner*—William E. Wayner

*Attorney, Agent, or Firm*—Darby & Darby

[57] ABSTRACT

The object of the present invention is to make it easy to separate a portion which takes charge of the operation control of an air conditioner from the air conditioner using a remote controller, and the essential points are that the control means of the air conditioner controls the operation of a compressor to make the room temperature detected by a first temperature sensing means approach to a set temperature set by a first temperature setting means, and further comprises a changeover switch, and a means for controlling the operation of the compressor based on a signal from the remote controller when the changeover switch is in a valid state; the remote controller disposed being detached from the air conditioner comprises a second temperature sensing means for detecting the room temperature and a second temperature setting means for setting a desired temperature and transmits a signal for controlling the operation of the compressor to make the temperature detected by the second temperature sensing means approach to a desired temperature set by the second temperature setting means to the control means.

7 Claims, 12 Drawing Sheets

AIR CONDITIONER

BACKGROUND OF THE INVENTION

The present invention relates to a proper constitution for connecting a remote controller to an air conditioner which has a portion for controlling the operation of the air conditioner.

There has been a controller for a conventional air conditioner as described in a Japanese Patent laid open No. Hei3-233247. The controller described in the gazette is the one to be mounted on an air conditioner, and operation signals are given to a compressor or a blower by operating a selection switch of the controller for controlling the operation of the air conditioner.

In a conventional air conditioner constituted as described in the above, a selection switch is mounted on an air conditioner itself, so that when a user operates the air conditioner, the user has to be on the side of the air conditioner.

When the selection switch is to be disposed in a place being convenient to the user, the electric circuit has to be improved by adding some parts such as a relay or a transformer; thereby there has been a problem that the quantity of electric work for the installation of a air conditioner is increased.

SUMMARY OF THE INVENTION

The present invention is invented for solving the problem as described in the above, and an object of the invention is to make it easy to detach a portion being in charge of the operation control of an air conditioner from the air conditioner by using a remote controller.

In the present invention, a controlling means of an air conditioner controls the operation of a compressor to make a room temperature detected by a first temperature sensing means approach to a set temperature set by a first temperature setting means, and further comprises a selection switch, and a means for controlling the operation of the compressor based on a signal from a remote controller when the selection switch is in a valid state. A remote controller disposed being detached from an air conditioner comprises a second temperature sensing means for detecting a room temperature and a second temperature setting means for setting a desired temperature, and a signal for controlling the operation of a compressor to make the temperature detected by the second temperature sensing means approach to the desired temperature set by the second temperature setting means is transmitted to a control means; owing to the constitution as described in the above, when an air conditioner is installed the electric work can be easily performed even if a user desires to perform the operation control of an air conditioner either on the side of the air conditioner or through a remote controller.

BRIEF DESCRIPTION OF THE DRAWINGS

The above and other objects, features and advantages of the present invention will be more apparent from the following description taken in connection with the accompanying drawings, wherein.

DETAILED DESCRIPTION OF THE PREFERRED EMBODIMENTS

An embodiment of an air conditioner according to the present invention will be explained using FIG. 1 to FIG. 4 in the following.

Figure 1:
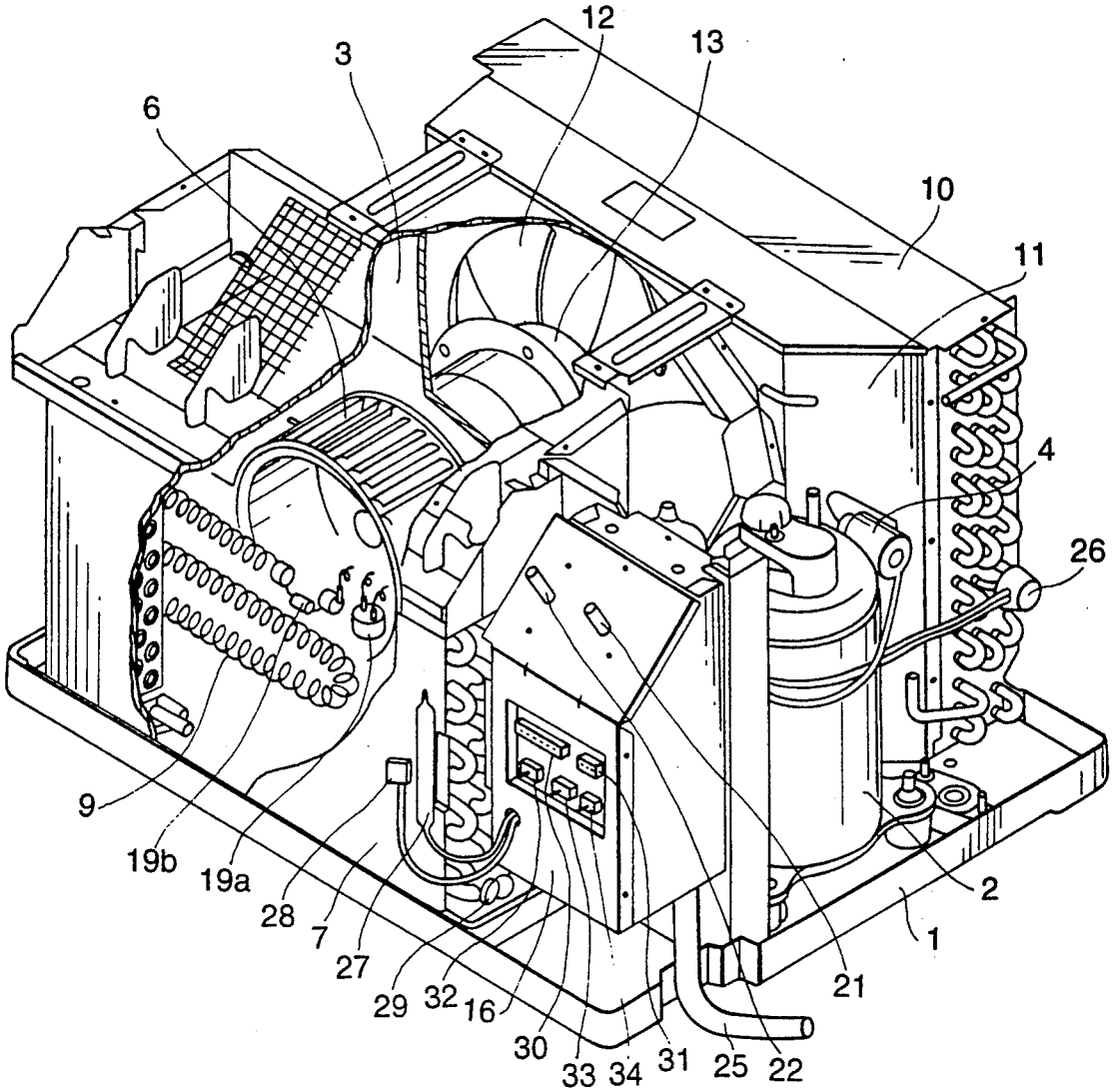
FIG. 1 is a perspective view, partly broken away, of an air conditioner showing an embodiment according to the present invention.

FIG. 1 is a perspective view in which the casing of an air conditioner is taken off and portions are broken away. In FIG. 1, reference numeral 1 denotes a bottom plate of an air conditioner made of a worked sheet metal, and reference numeral 2 denotes a compressor which constitutes a refrigerating cycle together with an indoor side heat exchanger 7, an outdoor side heat exchanger 10, a four-way valve 4 and an expansion device. When the indoor side heat exchanger 7 works as an evaporator and the outdoor side heat exchanger 10 works as a condenser, the compressor 2, an indoor side blower and an outdoor side blower are operated, and cooling operation is performed to cool a room to be air conditioned. Heating operation for the room to be air conditioned is possible when the indoor side heat exchanger 7 is operated as a condenser and the outdoor side heat exchanger 10 is operated as an evaporator by changing over the four-way valve.

Reference numeral 3 denotes a partition wall which separates the inside of the air conditioner to an outdoor side room and an indoor side room. In the outdoor side room, the compressor 2, the outdoor side blower 12 (a propeller fan), the outdoor side heat exchanger 10, a fun casing 11, etc. are provided. Reference numeral 13 denotes a motor provided in the outdoor side room, and when the motor is run, the open air sucked in through a backside grille flows through the side portion of the outdoor side heat exchanger 10 and supplied to the outdoor side heat exchanger 10 from the backside of the fun casing 11. Reference numeral 26 denotes a defrost detector provided on the side of the outdoor side heat exchanger 10, and when the outdoor heat exchanger 10 is frosted the contact arm of the defrost detector is closed.

In the indoor side room, there are provided the indoor side blower 6 (a sirocco fan), the indoor side heat exchanger 7, an electric heater 9, etc. The indoor side blower 6 is connected to the shaft of the motor 13, being supported at both end portions, together with the outdoor side blower 12, and when the motor 13 is run the indoor side blower 6 is rotated together with the outdoor side blower 12. Therefore, when the motor 13 is operated, the air in the room to be air conditioned which is sucked in from the suction grille of the indoor side room is cooled or heated in the indoor side heat exchanger 7, and further after the air is heated by the electric heater 9, the air is discharged into the room to be air conditioned from the discharge grille of the indoor side room. The suction grille and the discharge grille are formed into a cabinet of synthetic resin fixed on the bottom plate 1. Reference numeral 19*a* denotes a thermal switch (a protection switch for high temperature) which detects the temperature of the electric heater 9, and if the temperature is raised above a specified protection temperature the contact arm is opened, and 19*b* is a fuse to be melted when the current of the heater 9 is increased more than a specified current value.

Reference numeral 16 denotes an electric equipment box and control equipment, an electric equipment substrate, etc. are housed in it. Reference numerals 21 and 22 are switches which transmit signals to the controller, and the former is a selection switch for changing over the operation modes of the air conditioner (a COOL mode for operating cooling said room, a FAN mode for drafting the air to the room, an OFF mode for stopping the air condition and a HEAT mode for heating the room), and the latter is a thermostat set a desired temperature (the contact arm is changed over based on the comparison between a room temperature of the room and the set desired temperature). Reference numeral 25 denotes a power supply cord for supplying electric power to the electric equipment box.

The thermostat 22 detects the room temperature in the room, and contact arms 22*a* and 22*b*, to be described later, are opened or closed by the temperature expansion of a gas sealed inside the temperature sensing portion 27. The thermostat 22 is fixed to be able to detect the room temperature in the room, that is, the room temperature, the air which is sucked in by the indoor side blower 6 provided on the primary side of the indoor side heat exchanger 7.

Reference numeral 28 denotes a temperature detector and it is provided at a similar position to the above mentioned temperature sensing portion 27. In the case of the temperature detector 28 the set temperature is fixed, and when the room temperature rises higher than the set temperature (3° C.), the contact arm being normally closed is opened.

Reference numeral 29 denotes a thermostat for preventing freezing, and it detects the freezing of the indoor side heat exchanger 7 and opens the contact arm being normally closed. The detection of freezing is performed when the temperature of the indoor side heat exchanger 7 is lowered below or equal to −7° C.

Reference numeral 32 denotes a connector to which a remote controller is connected, and reference numeral 31 denotes a connector to which signal lines of a centralized controller is connected.

Reference numeral 32 denotes a fan cycle switch, and when the switch is positioned on FC side, the ON/OFF of the motor 13 can be interlocked with the ON/OFF of the compressor 2. When the switch is positioned on CONT side, the motor 13 makes continuous operation independent of the ON/OFF of the compressor 2.

Reference numeral 33 denotes a changeover switch, and when the switch is positioned on "a" side, the air conditioner is controlled by operation signals (DC voltages) from the remote controller connected to the connector 30, and when the switch is positioned on "b" side, the air conditioner is controlled by operation signals (DC voltages) from the selection switch 21.

Reference numeral 34 denotes a power switch of the air conditioner.

Figure 2:
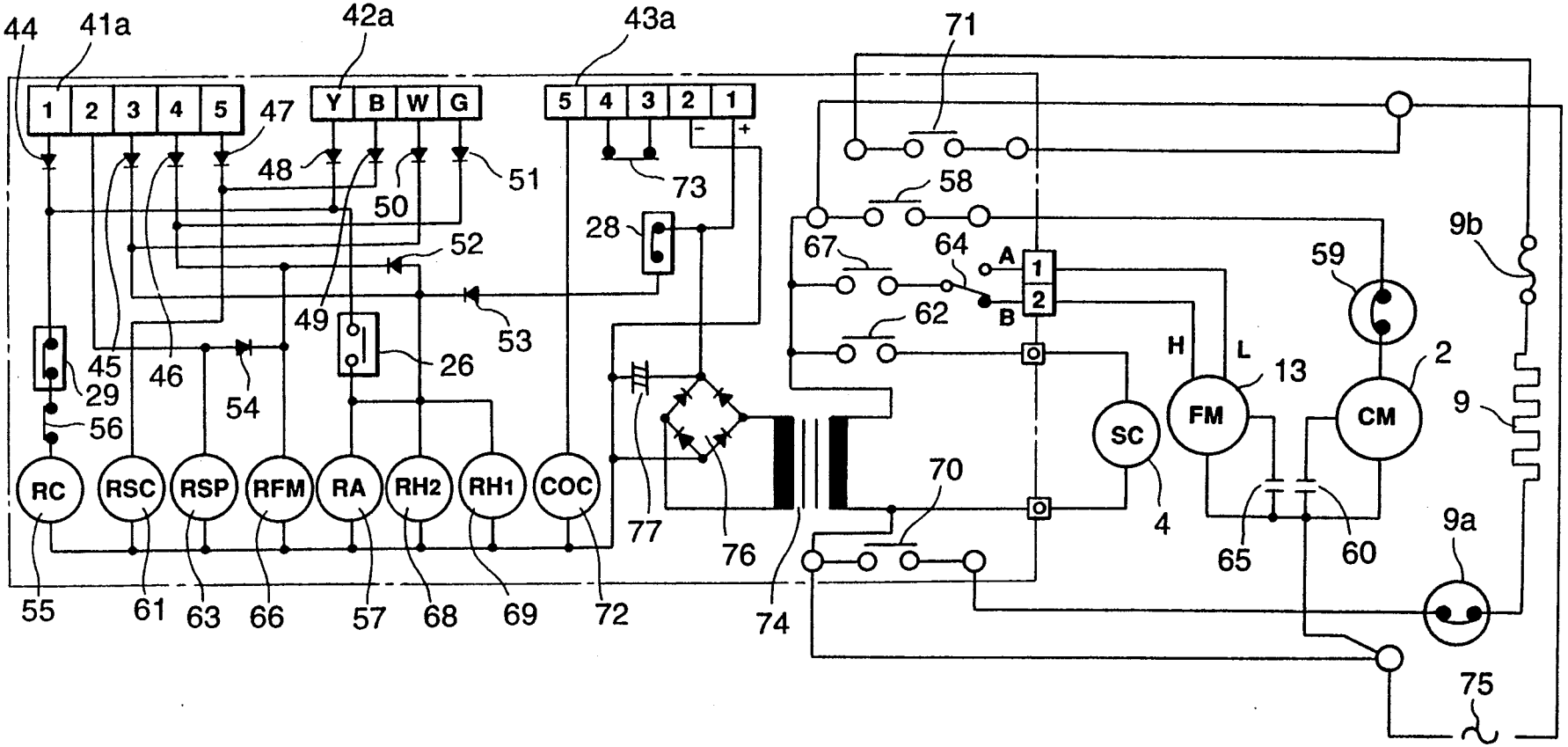
FIG. 2 shows an electric circuit diagram to be used for the control of the air conditioner shown in FIG. 1.
Figure 3:
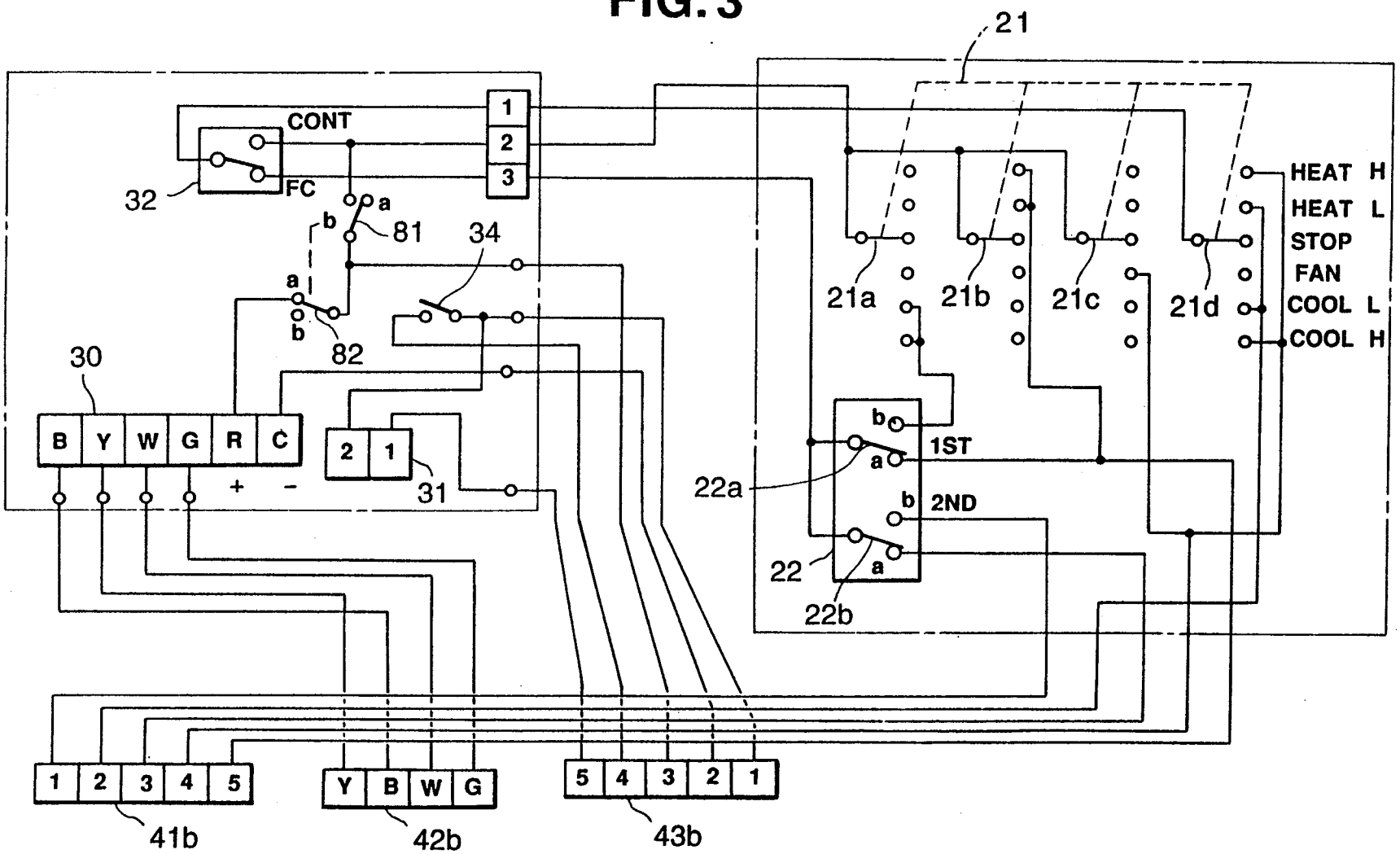
FIG. 3 also shows an electric circuit diagram to be used for the control of the air conditioner shown in FIG. 1.

FIG. 2 and FIG. 3 are electric circuit diagrams to be used for the air conditioner shown in FIG. 1. In these figures, a connector 41*a* and a connector 41*b*, a connector 42*a* and a connector 42*b*, and a connector 43*a* and a connector 43*b* are connected; the terminals having the same terminal reference numerals are connected to each other respectively, and the electric circuits shown in FIG. 2 and FIG. 3 are electrically constituted.

In FIG. 2, reference numerals 44 to 54 denotes diodes which limit the direction of the flows of operation signals (DC voltages) to one direction.

Reference numeral 55 denotes an auxiliary relay, and it is energized by a DC current which flows through the freezing preventive thermostat 29 and a normally closed contact arm 56. The normally closed contact arm 56 is opened when an auxiliary relay 57 is energized. When the normally closed contact arm 56 or the contact arm of the freezing preventive thermostat 29 is opened, the power supply to the auxiliary relay 55 is cut off to open a normally opened contact arm 58 of the auxiliary relay 55, and the power supply to the compressor 2 is cut off. Reference numeral 59 denotes an overload switch of the compressor 2, and when the current which flows through the compressor 2, that is, the current which flows through the contact arm of the overload switch (bimetal contact arm) becomes too heavy for the compressor 2, the contact arm itself is heated to break the circuit. Reference numeral 60 denotes a capacitor to be used for the operation when a single phase motor is used as a driving source of the compressor 2.

Reference numeral 61 denotes an auxiliary relay having a normally opened contact arm 62. Therefore, when the auxiliary relay 61 is energized the normally opened contact arm 62 is closed and the four-way valve 4 is switched over to the side of heating operation.

Reference numeral 63 denotes a changeover relay having a changeover contact arm 64. Therefore, when the changeover relay 63 is energized, the position of the changeover contact arm 64 is switched from B to A, and the number of revolutions of the motor 13 is switched from high to low. Reference numeral 65 denotes a capacitor to be used for operation when a single phase motor is used as a motor 13.

Reference numeral 66 denotes an auxiliary relay having normally opened contact arm 67. Therefore, when the auxiliary relay 66 is energized, the normally opened contact arm 67 is closed to operate the motor 13.

Reference numerals 68 and 69 denote auxiliary relays having normally opened contact arms 70 and 71 respectively. Therefore, when the auxiliary relays 68 and 69 are energized, the normally opened contact arms 70 and 71 are closed to energize the electric heater 9.

Reference numeral 72 denotes an auxiliary relay having normally closed contact arm 73. Therefore, when the auxiliary relay 72 is energized, the normally closed contact arm 73 are opened and the connection between the terminal 3 and the terminal 4 is released.

Reference numeral 74 denotes a step down transformer for lowering the AC voltage supplied from an AC power source 75. The AC power, voltage-step-downed, is rectified by a full wave rectifier 76 and smoothed by a smoothing capacitor 77. The rectified and smoothed DC power is supplied to a terminal 1 and a terminal 2 of the connector 43*a*.

In FIG. 2, the range surrounded with a one dot chain line shows the portions mounted on a printed substrate.

In FIG. 3, reference numerals 81 and 82 denote changeover switches whose contact arms are changed over by operating the above-mentioned changeover switch 33, and the contact arms are changed over from side "a" to side "b" or vice versa being interlocked. When the power switch 34 is closed and the contact arms of the changeover switches 81 and 82 are positioned on side "a" (a valid state), DC power supplied from the terminal 1 of the connector 43*b* is supplied to the side "a" of the switch 82 through the power switch 34 and the normally closed contact arm 73, and further the DC power is supplied to the remote controller through the connector 30. When the contact arm is positioned on side "b" (an invalid state), the DC power supplied from the terminal 1 of the connector is supplied to the selection switch 21 and the thermostat 22 through the fan cycle switch 32.

The selection switch 21 has contact arms 21*a* to 21*d* which are operated being interlocked, and they correspond to a strong heating mode (HEAT H), a weak heating mode (HEAT L), stop (STOP), a draft mode (FAN), a weak cooling mode COOL( L) and a strong cooling mode (COOL H). For example, when the contact arms 21*a* to 21*d* of the selection switch 21 are in STOP positions, power is not supplied to any terminal of the connector 41*b* and all the auxiliary relays shown in FIG. 2 are not energized, so that the air conditioner is in a stop state.

When the contact arms 21*a* to 21*d* of the selection switch 21 are in HEAT H positions, the contact arms 21*b* and 21*d* are connected. When the contact arm 21*b* is connected, the auxiliary relay 61 shown in FIG. 2 is energized through the terminal 5 of the connector 41*b*, and the four-way valve 4 is switched over to a refrigerating cycle for heating operation. At the same time, the auxiliary relay 55 or auxiliary relays 57, 68 and 69 shown in FIG. 2 are energized through a 1st contact arm and a 2nd contact arm of the thermostat 22.

The thermostat 22 has contact arms 22*a* and 22*b* which are switched over according to a detected temperature, and in the case of the contact arm 22*a*, a changeover temperature (a set temperature) to side "a" or to side "b" can be changed arbitrarily in the range of 18° C. to 32° C., and when the detected temperature is higher than the changeover temperature the contact arm 22*a* is positioned on side "b". In the case of the contact arm 22*b*, the changeover temperature, from side "a" to side "b" or vice versa, is changed interlocking with the contact arm 22*a*, and it is set automatically to a temperature lower than that of the contact arm 22*a* by 1.5° C. When the room temperature is lower than the temperature the contact arm 22*b* is switched to side "a".

Therefore, in the heating operation (in a strong heating mode and in a weak heating mode), the contact arm 22*a* is switched over according to a detected temperature and a set temperature of the thermostat 22, and further, when the contact arm 22*a* is on side "a", the operation is changed over from the operation of the compressor 2 to the energizing of the electric heater 9 or vice versa according to the state of the contact arm 22*b* of the thermostat 22, if it is on side "a" or on side "b".

When the contact arm 22*b* of the thermostat 22 is positioned on "a" side (in a state as shown in FIG. 3), the auxiliary relays 57, 68 and 69, shown in FIG. 2, are energized through a terminal 3 of the connector 41*b* and the electric heater 9 is energized. At the same time, the normally closed contact arm 56 is opened and the power supply to the auxiliary relay 55 is cut off. When the contact arm 22*b* is positioned on "b" side, the auxiliary relay 55 is energized through a terminal 1 of the connector 41*b* and the compressor 2 is operated.

During the operation of the compressor 2, if the contact arm of the freezing preventive thermostat 29 is opened, the operation of the compressor 2 is stopped and the indoor side heat exchanger 7 is defrosted; when the contact arm of the frost detector 26 is closed, the auxiliary relays 57, 68 and 69 are closed, and the operation of the electric heater 9 is performed.

Next, when the contact arm 21*d* of the selection switch 21 is connected to the power supply, if the operation mode is the strong heating mode (or strong cooling), the auxiliary relay 66 is energized and the normally opened contact arm 67 is closed, and the motor 13 is operated in the high speed. If the contact arm 21*d* is positioned at the weak heating mode (or the weak cooling mode), the auxiliary relays 63 and 66 are energized, the normally opened contact arm 67 is closed, the normally opened contact arm 64 is changed over, and the motor 13 is operated in the low speed.

In the operation as described in the above, if the fan cycle switch 32 is positioned on side FC and the contact arm 22*a* of the thermostat 22 is positioned on side "a" (in the case of cooling operation, on side "b"), power is supplied to the contact arm 21*d* of the selection switch 21, and the operation of the motor 13 is controlled as described in the above. In other words, the motor 13 is operated only when the compressor 2 is operated by the action of the thermostat 22 or the electric heater 9 is being energized.

When the contact arm of the temperature detector 28 is closed (when the detected temperature is lower than or equal to 3° C.), the operation of the electric heater 9 is performed as mentioned in the above, and the temperature in the room to be air conditioned is controlled not to be below or equal to 3° C.

When the terminals of the connector 31 is short-circuited by an external controller, an auxiliary relay 72 is energized and the normally closed contact arm 73 is opened and power is not supplied to the selection switch 21, so that the operation of the air conditioner is not performed.

Figure 4:
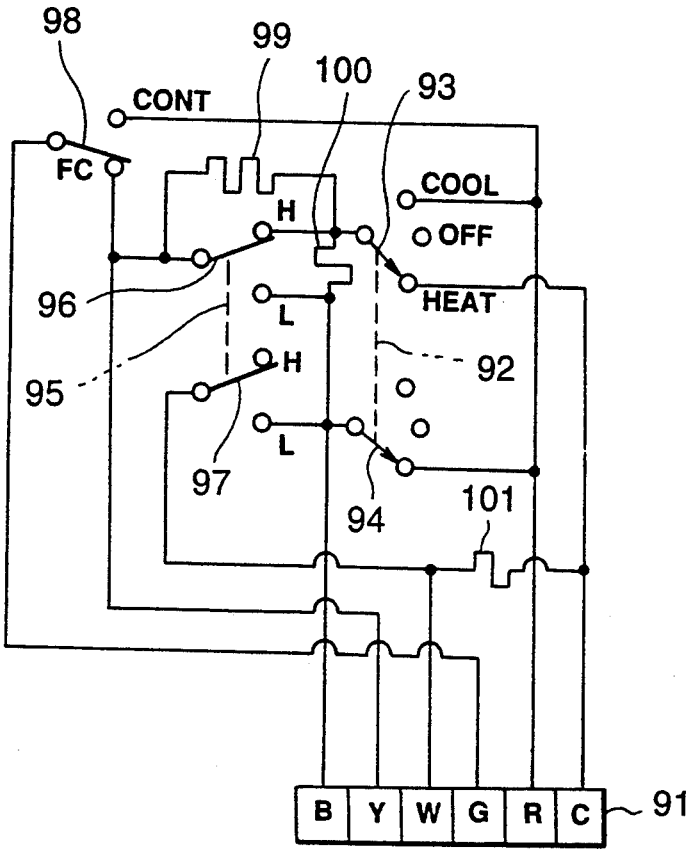
FIG. 4 shows an electric circuit diagram of a remote controller to be connected to a connector shown in FIG. 3.

FIG. 4 is a circuit diagram of a remote controller to be connected to the connector 30 shown in FIG. 3, and the remote controller is, for example, a 3AAT82B23A1 made by General Electric Company. In FIG. 4, reference numeral 91 denotes a connector and it has a constitution capable of being connected to the connector 30 shown in FIG. 3. In this case, the terminals of the connector 91 and those of the connector 30 having the same symbols are connected to each other.

The remote controller can be installed on the wall of a room to be air conditioned and the like.

Reference numeral 92 denotes a selection switch having interlocking contact arms 93 and 94. When the selection switch is positioned at COOL, DC power is supplied to the contact arm 93 through a terminal R of the connector 91, and when the selection switch is positioned at HEAT, DC power is supplied to the contact arm 94 through the terminal R of the connector 91 and the contact arm 93 is connected to the negative side of the DC power through a terminal C of the connector 91.

Reference numeral 95 denotes a thermostat having contact arms 96 and 97 which are switched over according to a detected temperature. The contact arm 96 is positioned on side H when the detected temperature is higher than the set value, and when the detected temperature is lower than the set value, it is positioned on side L. The set temperature can be set in the range of 50° F. to 90° F., and the differential when the contact arm 96 is switched over is 2° F. The contact arm 97, similar to the contact arm 96, is switched over to side L, when the detected temperature becomes lower than the specified temperature. The specified temperature is 40° F.

Reference numeral 98 denotes a fan cycle switch which has the same purpose as that of the fan cycle switch shown in FIG. 3 does.

Reference numerals 99 to 101 are electric heaters as anticipators, and they are energized in heating operation and heat the surroundings of the thermostat 95.

In the case of a remote controller constituted as described in the above, for example, when the detected temperature by the thermostat 95 in a heating operation is lower than a set temperature, DC power supplied from the terminal R of the connector 91 (when the switch 34 shown in FIG. 3 is ON and the changeover switches 81 and 82 are on side "a" (a valid state)) is supplied to the terminal Y of the connector 42*a* shown in FIG. 2 through the contact arm 94 of the selection switch 92, the contact arm 96 of the thermostat 95 (Since the detected temperature is lower than the set temperature, the contact arm is on side L.) and the terminal Y of the connector 91, and the auxiliary relay 55 is energized. At the same time, DC power is also supplied to the terminal B of the connector 42*a* shown in FIG. 2 through the terminal B of the connector 91, and the auxiliary relay 61 is energized. Further, DC power is also supplied to a terminal G of the connector 42*a* shown in FIG. 2 through a terminal G of the connector 91, and the auxiliary relay 66 is energized.

As described in the above, when auxiliary relays 55, 61 and 66 are energized, heating operation is performed based on a heat pump cycle.

In a case where a detected temperature of the thermostat 95 is low and a contact arm 97 is on side L, DC power supplied from the terminal R of the connector 91 is supplied to a terminal W of the connector 42*a* shown in FIG. 2 through the contact arm 94 of the selection switch 92, the contact arm 97 of the thermostat 95 and the terminal W of the connector 91, and auxiliary relays 57, 68 and 69 are energized.

Therefore, the operation of the compressor 2 is stopped, and heating operation by the electric heater 9 is performed.

When COOL is selected by the selection switch 92 shown in FIG. 4, DC power supplied from the terminal R of the connector 91 is supplied to the terminal Y of the connector 42*a* shown in FIG. 2 through the contact arm 93 of the selection switch 92, thermostat 95 and contact arm 96, the terminal Y of the connector 91, and the operation of the compressor 2 is performed similar to the case of heating operation. At this time, the auxiliary relay 61 is not energized, so that refrigerating cycle performs cooling operation.

According to the present embodiment, when the remote controller is connected to the connector 30, the operation control of an air conditioner can be performed from the remote controller by switching the changeover switches 81 and 82 to side "a" (a valid state) in operating the changeover switch 33; when the remote controller is not used, operation control can be performed on the air conditioner side by positioning the switches 81 and 82 on side "b" (an invalid state) in operating the changeover switch 33.

Figure 5:
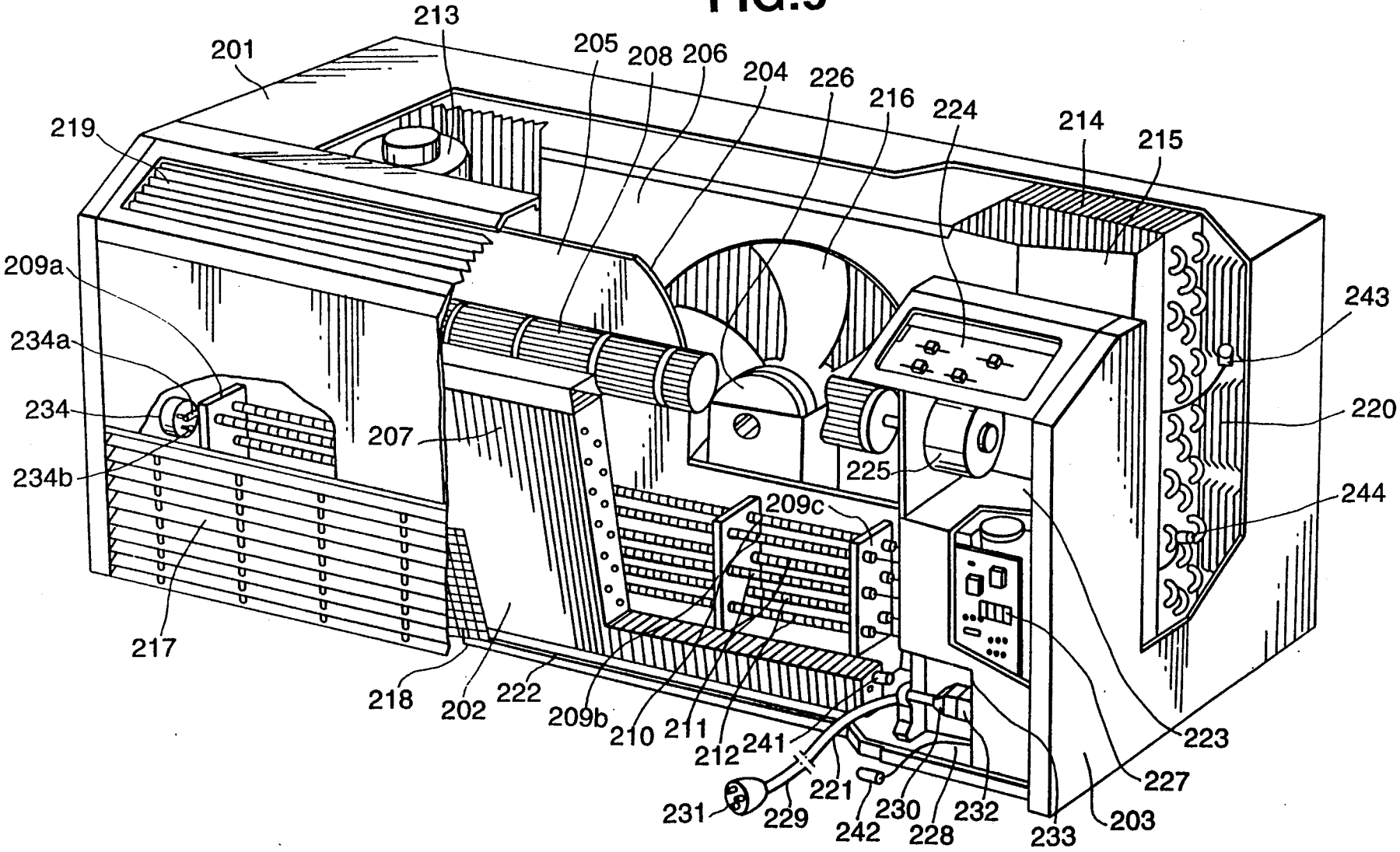
FIG. 5 is a perspective view, partly broken away, of an air conditioner showing another embodiment according to the present invention.

Next, another embodiment of an air conditioner according to the present invention will be explained using FIG. 5 to FIG. 12. FIG. 5 is a perspective view, partly broken away, of an air conditioner of the present embodiment. Reference numeral 201 denotes a housing which constitutes an air conditioner, and back side half of it is buried in the wall of a house in a manner that the back side of it is exposed to the open air. Reference numeral 203 is a front panel which covers an opening 202 on the front side of the housing 201.

Reference numeral 204 denotes a partition wall which separates the inside of the housing 201 into an indoor side space 205 on the front side and an outdoor side space 206 on the back side.

In the indoor side space 205 following parts are housed: a heat exchanger 207 of a plate fin type, a cross flow fan 208, first electric heater 210 of 2 kw and a second electric heaters 211 and 212 of 1.5 kw fixed with supporting portions 209*a*, 209*b* and 209*c*.

In the outdoor side space 206 following parts are housed: a compressor 213, a heat exchanger of a plate fin type 214, a fan casing 215, and a propeller fan 216 to be housed in the fan casing 215.

Air in a room to be air conditioned is sucked in by the cross flow fan 208 through an air suction port 217, an air filter 218, a heat exchanger 207, and electric heaters 210, 211 and 212, and after that, it is discharged into the room to be air conditioned through an air discharge port 119 provided on the front panel 203.

The open air is sucked in by the propeller fan 216 through the heat exchanger 214 from a grille 220 in a part of the back side of the housing 201, and it is discharged to the outside from a central grille on the back side.

In the case of a cooling mode, the heat exchanger 207 acts as an evaporator and cools the air inside the room. In the case of a heating mode, the heat exchanger 207 acts as a condenser and heats the air inside the room, and the energizing of the electric heaters 210, 211 and 212 are controlled based on the conditions set in a heating mode.

In the lower part of the front side of the housing 201 a low rib 222 is formed, and a space 221 is formed between the rib 222 and the front panel 203. The air inside the room is sucked in through the space 221 and the suction port 217.

Reference numeral 223 denotes a control box, and it is disposed on the right side of the indoor side space 205 of the housing 201. A first setting portion 224 which sets operating conditions is electrically connected to the control box 223. The compressor 213, a motor 225 for driving the cross flow fan 208, a motor 226 for driving the propeller fan 216, and electric parts for controlling the electric heaters 210, 211 and 212 are housed in the control box 223. Reference numeral 227 denotes a connector for connecting the remote controller.

Reference numeral 228 denotes a space for connecting the power supply and it is formed in a position opposing to the control box 223 in the space 221. A primary side connector 230 is connected to an end of a power supply cord 229 and a plug 231 which can be pulled out to the exterior of the housing 201 is connected to the other end of it through a space 221. A secondary side connector 232 which is to be engaged with the primary side connector 230 is mounted on a wall facing the space 228 of the control box 223.

Reference numeral 234 denotes a protector constituted with a temperature fuse 234*a* and a bimetal thermostat 234*b*, and in the case of an abnormal heating of electric heaters 210, 211 and 212 it cuts off the power supply to these electric heaters.

Reference numerals 241, 242, 243 and 244 are temperature sensors, and they are installed to be able to detect respective temperatures as shown below: 241 detects the temperature of the heat exchanger 207, 242 detects the room temperature, 243 detects the open air temperature, and 244 detects the temperature of the heat exchanger 214.

Figure 6:
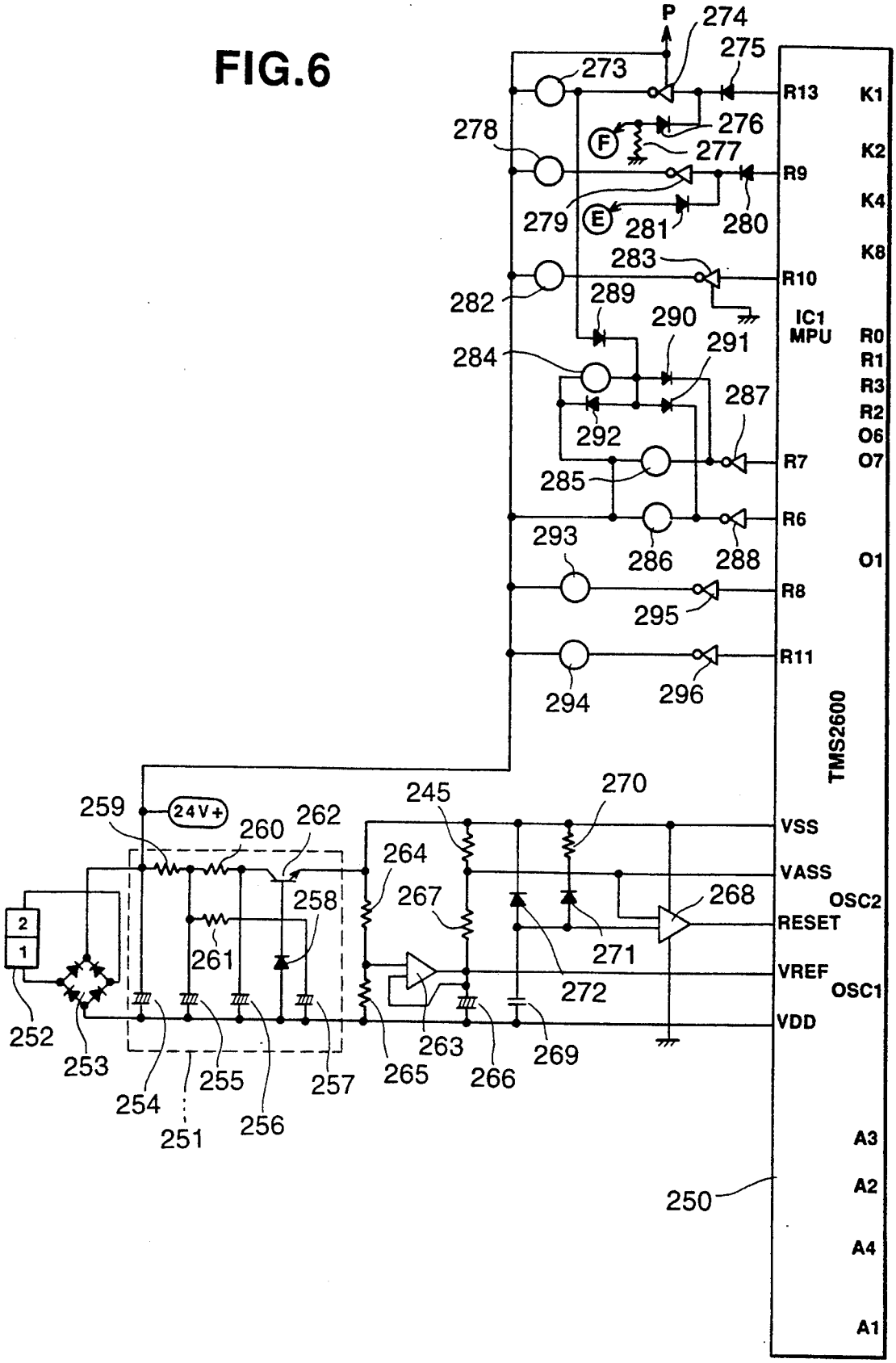
FIG. 6 is an electric circuit diagram to be used for the control of the air conditioner shown in FIG. 5.

FIG. 6 is electric circuit diagram to be used for the control of the air conditioner shown in FIG. 5. In the figure, reference numeral 250 denotes a microprocessor (TMS2600 of Texas Instruments), and it performs control operations based on the programs stored in the interior storage portion (ROM).

Reference numeral 251 denotes a voltage regulator circuit, and it stabilizes rectified power which is obtained after single phase AC power which is input through a connector 252 is rectified with a full-wave rectifier circuit (a diode bridge) 253. Reference numerals 254 to 257 are smoothing capacitors, and the capacitor 254 regulates DC +24 V, and a switching transistor 262 and a Zener diode 258 which makes the transistor 262 ON/OFF stabilizes DC +5 V. Reference numerals 259 to 261 are resistors for limiting the currents of the transistor 262 and the Zener diode 258.

Reference numeral 263 denotes a differential amplifier, and it is used as a current booster. Reference numerals 264 and 265 are resistors for a voltage divider, and a reference voltage decided by the resistors 264 and 265 is power-amplified by the differential amplifier 263 and then it is supplied to a terminal VREF of the microprocessor 250. Reference numeral 266 denotes a capacitor which stabilizes the voltage applied to the terminal VREF.

Reference numerals 245 and 267 are resistors for a voltage divider, and the divided voltage is supplied to a terminal VASS of the microprocessor 250. The microprocessor 250 sets the voltage difference between the voltages applied to the terminals VREF and VASS as an analog input voltage to be used in the case of A/D (analog/digital) conversion.

Reference numeral 268 denotes a differential amplifier, and it is used as a comparator for giving a reset signal to the microprocessor 250; the differential amplifier 268 gives a reset signal to the microprocessor when the terminal voltage of a capacitor 269, in which electric charge is accumulated through a resistor 270 and a Zener diode 271, becomes higher than the voltage being applied to the terminal VASS. A diode 272 forms a discharge path of an electric charge accumulated in the capacitor 269.

Reference numeral 273 denotes a relay coil, and when the relay coil 273 is energized, the cross flow fan 208 is rotated for drafting. The relay coil 273 is energized with an inverter circuit (a buffer) 274 which is operated corresponding to an output given from a terminal R13 or F (to be connected to F shown in FIG. 7) of the microprocessor 250. When an voltage H (+5 V) is given to the inverter circuit 274, the relay coil 273 is energized. Reference numerals 275 and 276 denote diodes to be used for protection, and 277 is a resistor.

Reference numeral 278 denotes a relay coil, and when the relay coil is energized, a four-way valve, not shown in a drawing, is energized. When the four-way valve is energized, the direction of flow of refrigerant is changed, and cooling mode/heating mode is selected. In a state where the relay coil is not energized a cooling mode is selected and the indoor side heat exchanger 207 acts as an evaporator and the outdoor side heat exchanger 214 acts as a condenser and cooling operation is performed, and in a state where the relay coil is energized a heating mode is selected, and the indoor side heat exchanger 207 acts as a condenser and the outdoor side heat exchanger 214 acts as an evaporator and cooling operation is performed. Reference numeral 279 denotes an inverter circuit, and 280 and 281 are diodes, and E is connected to E shown in FIG. 7.

Reference numeral 282 denotes a relay coil, and when the relay coil is energized, the number of revolutions of the cross flow fan 208 and that of the propeller fan 216 are switched over. In a state where the relay coil is not energized they are operated in a low speed, and in a state where it is energized they are operated in a high speed. Reference numeral 283 denotes an inverter circuit.

Reference numerals 284 to 286 denote relay coils, when the relay coil 284 and the relay coil 285 are energized the electric heater 210 is energized, and when the relay coil 284 and the relay coil 286 are energized the electric heater 211 and the electric heater 212 are energized. When a signal is output from the terminal R7 of the microprocessor 250, relay coils 284, 285 and 273 are energized, and when a signal is output from the terminal R6, relay coils, 284, 286 and 273 are energized. Reference numerals 287 and 288 denote inverter circuits, and 289 to 292 are diodes.

Reference numerals 293 and 294 denote relay coils, and when the relay coil 293 is energized, the compressor 213 is energized, and when the relay coil 294 is energized the propeller fan 216 is rotated. Reference numerals 295 and 296 denote inverter circuits.

Figure 7:
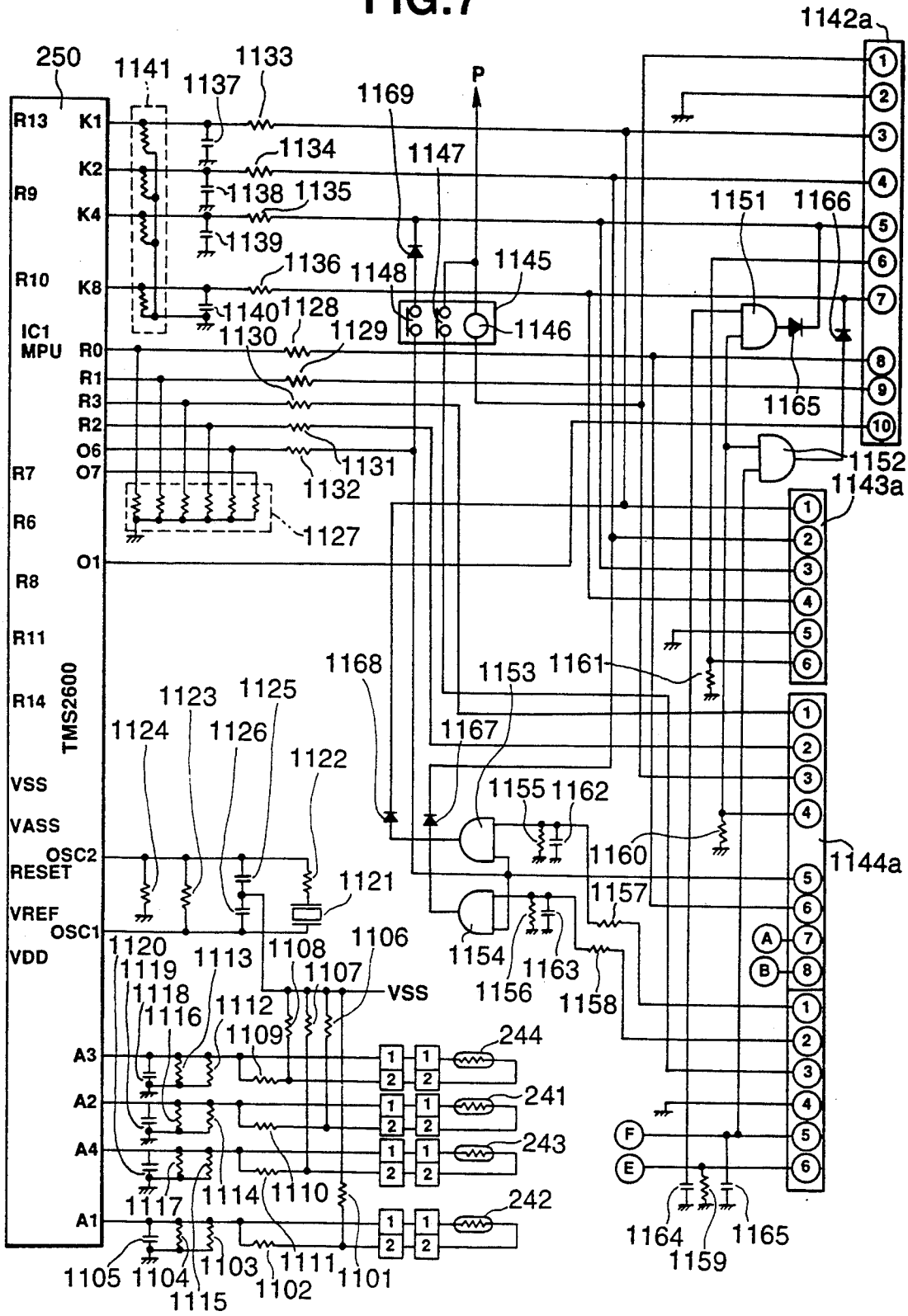
FIG. 7 is also an electric circuit diagram to be used for the control of the air conditioner shown in FIG. 5.

P shown in FIG. 6 is connected to P shown in FIG. 7.

In FIG. 7, the terminals A1 to A4 of the microprocessor 250 are input terminals for analog voltages, and the microprocessor 250 makes A/D conversion of the voltages applied to these terminals and stores inside. A temperature sensor 242 which detects the room temperature is connected to the terminal A1. Reference numerals 1101 to 1104 are resistors, and they constitute circuits for linearizing the voltage changes corresponding to the changes of internal resistances based on the detected temperature by the temperature sensor 242. Reference numeral 1105 denotes a capacitor for absorbing noise.

In a similar way, the temperature sensor 241 for detecting the temperature of the heat exchanger 207 is connected to the terminal A2, the temperature sensor 244 for detecting the temperature of the heat exchanger 214 is connected to the terminal A3, and the temperature sensor 243 for detecting the temperature of the open air is connected to the terminal A4. Reference numerals 1106 to 1117 are resistors, and in a similar way, they constitute circuits for linearizing the voltage changes of respective sensors. Reference numerals 1118 to 1120 are capacitors for absorbing noise.

Reference numeral 1121 denotes a quartz oscillator and it constitutes circuit together with resistors 1122 to 1124 and capacitors 1125 and 1126. The oscillation signal obtained from the oscillator circuit becomes a reference signal of the microprocessor 250.

The terminals, R0, R1, R2, R3, O6, and O7, are output terminals for scan outputs, and terminals, K1, K2, K4 and K8, are scan input terminals. The microprocessor 250 judges the set state of the first setting portion 224 shown in FIG. 8 and FIG. 9 based on the open or the close between these terminals and stores the judgment results. Reference numeral 1127 denotes a resistor array for protecting the output terminals, and reference numerals 1128 to 1132 denote output resistors connected to output terminals. Reference numerals 1133 to 1136 denote resistors and reference numerals 1137 to 1140 denote capacitors and they constitute filter circuits for suppressing the invasion of noise into respective input terminals. Reference numeral 1141 denotes a resistor array for protecting input terminals.

Figure 8:
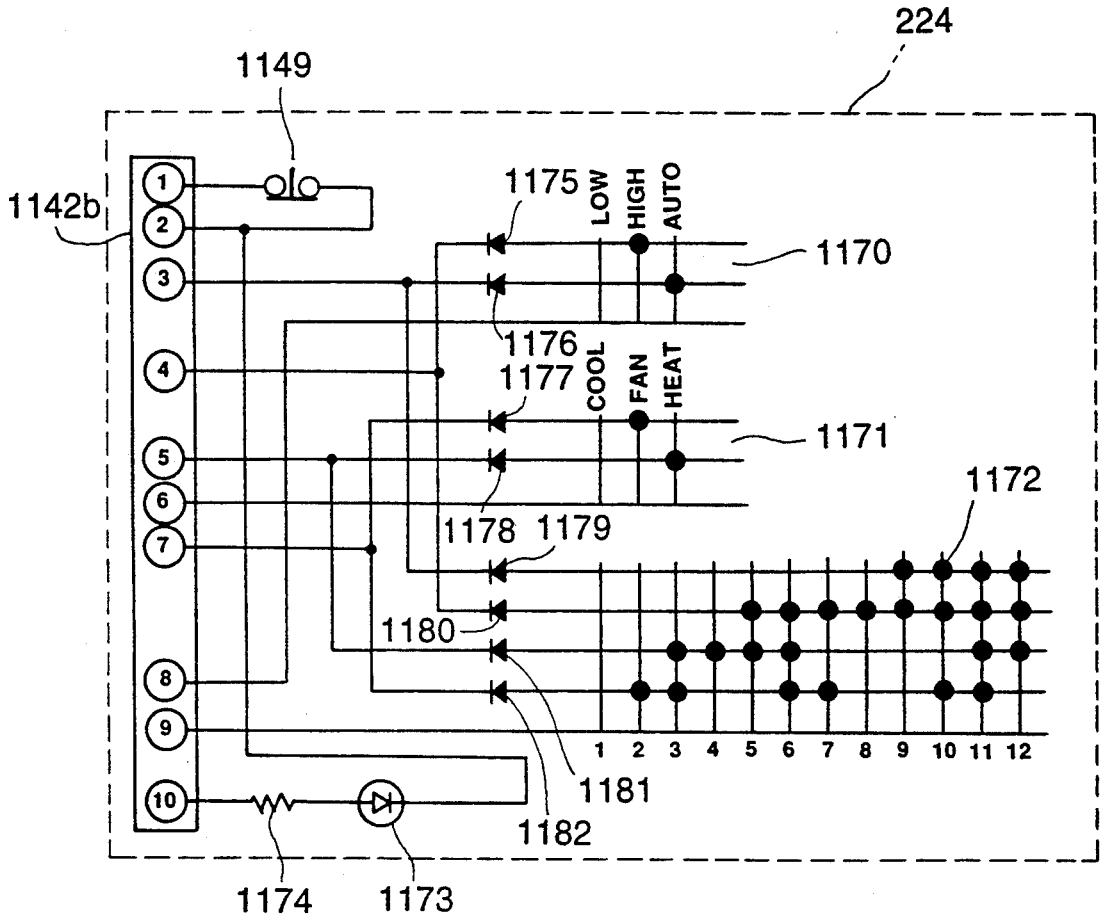
FIG. 8 shows an electric circuit diagram to be connected to a connector in the electric circuit shown in FIG. 7.
Figure 9:
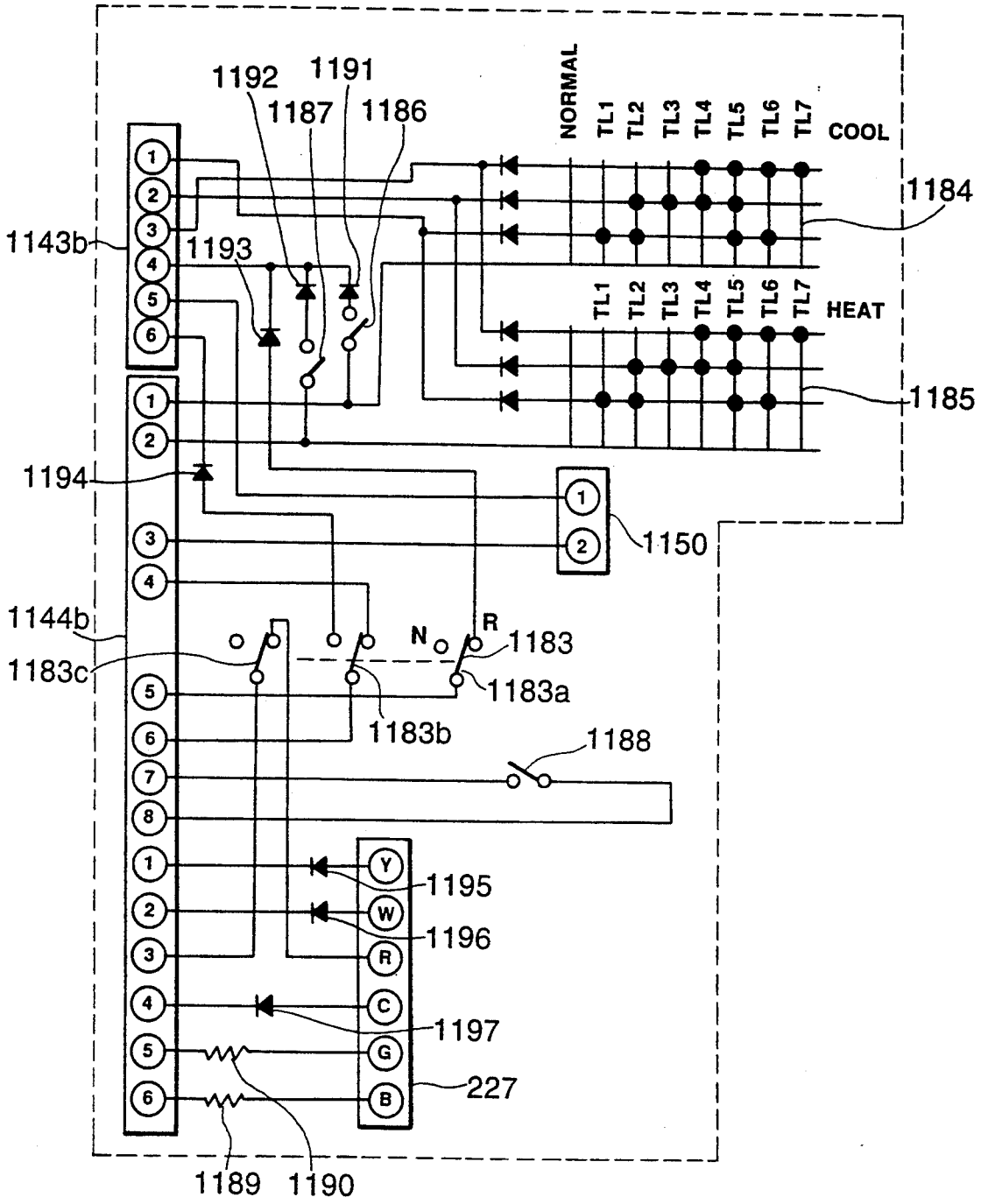
FIG. 9 also shows an electric circuit diagram to be connected to a connector in the electric circuit shown in FIG. 7.

Reference numerals 1142*a*, 1143*a*, and 1144*a* denote connectors, and the connector 1142*a* is connected to the connector 1142*b* shown in FIG. 8 in a manner that the terminals having the same numbers are connected to each other and in a similar way the connector 1143*a* is connected to the connector 1143*b* shown in FIG. 9, and the connector 1144*a* is connected to the connector 1144*b* shown in FIG. 9.

Reference numeral 1145 denotes an auxiliary relay having a coil 1146 and normally opened contact arms 1147 and 1148. FIG. 7 shows a state where the coil 1146 is energized. The coil 1146 is energized when the contact arm of an operation switch 1149 shown in FIG. 8 (In each time when it is depressed, the open or close of contact points are changed over.) is closed, or when the terminals of a connector 1150 shown in FIG. 9 are short-circuited. An open/close switch, not shown in a drawing, is connected to the connector 1150, and the open/close switch is used for remote control operation.

Reference numerals 1151 to 1154 denote AND gates which AND input signals. Reference numerals 1155 to 1161 denote resistors, 1162 to 1164 denote capacitors, and 1166 to 1169 are diodes.

FIG. 8 is an electric circuit diagram of the first setting portion 224 shown in FIG. 5 which sets operating conditions of an air conditioner, the draft quantity, the operation mode, the set temperature, etc. Reference numeral 1170 denotes a draft quantity selection switch which sets the number of revolutions of the cross flow fan 208. The setting is performed by switching over a knob of the first setting portion 224 to LOW small draft quantity), HIGH (large draft quantity) or AUTO (When the room temperature is close to the set temperature the switch is automatically switched over to small draft quantity and when it is not the switch is automatically switched over to large draft quantity.).

Reference numeral 1171 denotes an operation mode selection switch, and each mode, COOL (cooling mode), FAN (drafting mode), or HEAT (heating mode), is set with a knob. Reference numeral 1172 denotes a temperature setting switch, and a value out of values 1 to 12 is set with a knob. Respective room temperature set values are decided corresponding to respective values of 1 to 12.

Reference numeral 1173 denotes a service lamp; it is lighted when a trouble occurs in an air conditioner. The lamp 1173 is connected to a terminal 01 of a microprocessor 250 shown in FIG. 7 through a resistor 1174. Therefore, when the output of the terminal 01 reaches a voltage level H (+5 V), the lamp 1173 is lighted.

The setting states of switches 1170, 1171 and 1172 are judged depending on the existence of scan outputs which are output from the terminals R0 and R1 of the microprocessor 250 shown in FIG. 7, which can be investigated by inputting the scan outputs to the scan terminals K1, K2, K4 and K8, and the judgment result is stored. For example, when the knob of the draft quantity setting switch 1170 is set at AUTO, the scan output which is output from the terminal R0 is transmitted to the terminal K1 for judgment.

Reference numerals 1175 to 1182 denote diodes, and they regulate the direction of transmission of the scan outputs.

FIG. 9 is an electric circuit diagram of a switch portion provided in the control box 223 shown in FIG. 5.

Reference numeral 1183 denotes a changeover switch, and it sets whether a remote controller is to be connected to the connector 227 (R: a valid state) or not (N: an invalid state). A contact arm 1183*a* is set on side R by setting the changeover switch 1183 on side R (a valid state) and the scan signal output from the terminal 06 of the microprocessor 250 is constantly given to the terminal K8, which makes the microprocessor judge that the switch 1183 is set on side R. When the contact arm 1183*b* is set on side R, the scan signal output from the terminal R0 of the microprocessor 250 is given to the side of AND gates 1151 and 1152 shown in FIG. 7, and when the contact arm 1183*b* is on side N (an invalid state) scan signal is given to the switch 1171 shown in FIG. 8.

Therefore, when the remote controller is connected to the connector 227 the setting by the switch 1171 becomes invalid, and setting signals from the remote controller are given to the terminals K4 and K8 of the microprocessor 250 through the AND gates 1151 and 1152.

When the contact arm 1183*c* is on side R, DC power of +24 V is supplied to the terminal R of the connector 227.

Reference numerals 1184 and 1185 are setting switches, and they perform respectively the raising of the lower limit value of the temperature setting switch 1172 in the cooling mode, and the lowering of the upper limit value of the temperature setting switch 1172 in the heating mode. For example, when the setting of the setting switch 1184 is TL1, the value set at 1 of the switch 1172 is changed to the same value as that set at 2, and when the setting value of the setting switch 1184 is TL2, the values set at 1 and 2 of the setting switch 1172 are changed to the same value as that set at 3, and when the setting of the setting switch 1184 is TL7, the values set at 1 to 7 of the switch 1172 are changed to the same value as that set at 8 (refer to U.S. Pat. No. 4,898,230).

Reference numeral 1186 denotes a switch to make the setting of the setting switch 1184 valid, and 1187 is a switch to make the setting of the setting switch 1185 valid.

Reference numeral 1188 denotes a power supply switch which operates the open/close of power supply lines in the state where the terminals A and B shown in FIG. 7 are connected to the power supply lines.

Reference numerals 1189 and 1190 denote resistors, and 1191 to 1197 are diodes which regulate the direction of the flow of signals.

Figure 10:
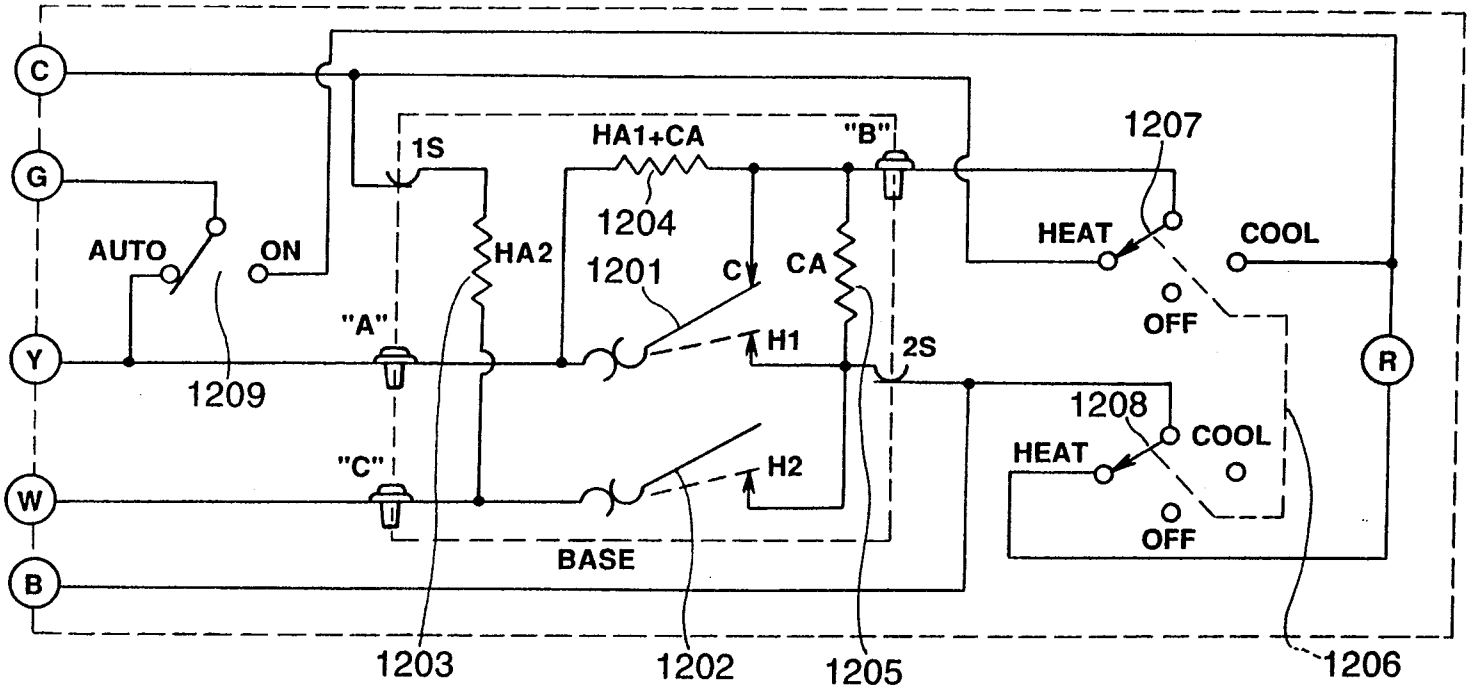
FIG. 10 is an electric circuit diagram of a remote controller to be connected to the connector in the electric circuit shown in FIG. 9.

FIG. 10 is an electric circuit diagram of a remote controller (a second setting portion, for example, 3AAT82B23A1 of General Electric) which is to be connected to the connector 227 shown in FIG. 9 in a manner that the terminals on both sides having the same symbols are connected to each other. Reference numerals 1201 and 1202 are operation contact arms of thermostats, and they can be changed over to or from side C, side H1, open circuit, or side H2 according to the relative values of set temperatures and detected temperatures. The operation contact arm 1202 is constituted to operate at a lower temperature by a specified value than that of the operation contact arm 201. Reference numerals 1203 to 1205 are electric heaters, and they are energized when the operation contact arms 1201 and 1202 are on side H1 and side H2, and give a differential between the operations of the operation contact arms 1201 and 1202.

Reference numeral 1206 denotes a changeover switch for operation modes, and sets operation modes (HEAT, OFF, COOL). Reference numerals 1207 and 1208 are interlocking changeover contact arms and they are changed over corresponding to an operation mode. When the changeover contact arms 1207 and 1208 are on side HEAT (heating mode), power is supplied to the operation contact arms 1201 and 1202 through the changeover contact arm 1208. When a detected temperature is lower than a set temperature, since the operation contact arm 1201 is on side H1, a DC voltage signal of +24 V (an ON signal of the compressor) obtained from the terminal R is output to the terminal Y. When a detected temperature becomes lower than a set temperature by a specified value, the operation contact arm 1202 is switched to side H2, so that, in a similar way, a DC voltage signal of +24 V (an energizing signal for an electric heater to be used as an auxiliary heat source) is output. A DC voltage signal of +24 V (a changeover signal for a four-way valve) is constantly output from the terminal B.

When the changeover contact arms 1207 and 1208 are on the COOL sides (cooling mode) power is supplied to the operation contact arm 1201 through the changeover contact arm 1207. When the detected temperature is higher than the set temperature, since the operation contact arm 1201 is on side C, the DC voltage signal of +24 V is output to the terminal Y.

Reference numeral 1209 denotes a fan control switch, and when it is on side AUTO, a DC voltage signal (an operation signal for a cross flow fan 208) of +24 V is output from the terminal G in synchronization with the DC voltage signal output from the terminal Y. In other words, a signal for making the operation of the cross flow fan 208 interlock with the ON/OFF of the compressor 213 is output from the terminal G. When the fan control switch 1209 is on side ON (continuous operation), a DC voltage signal is continuously output independent of the ON/OFF of the compressor 213.

In the case of the air conditioner constituted as described in the above, when the changeover switch 1183 shown in FIG. 9 is on side N (an invalid state), air conditioning operation is performed based on the operating conditions set in the first setting portion 224 shown in FIG. 8. When the changeover switch 1183 is on side R (a valid state), air conditioning operation is performed based on the operating conditions set by the remote controller shown in FIG. 10 and other operating conditions which are not set by the remote controller (settings by a draft quantity selection switch, setting switches 1184 and 1185, etc.).

Figure 11:
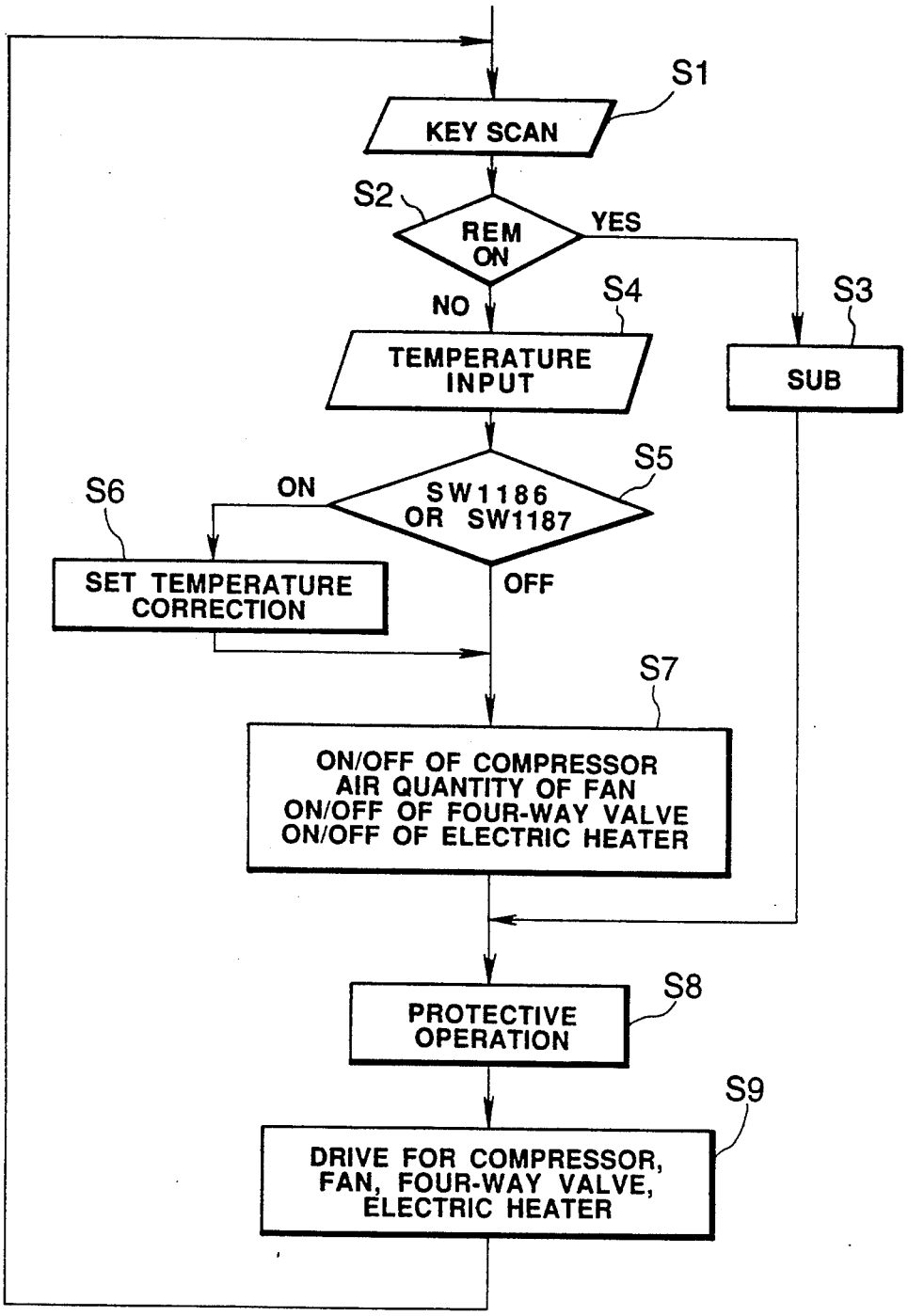
FIG. 11 is a flow chart showing main operations of the air conditioner shown in FIG. 5.
Figure 12:
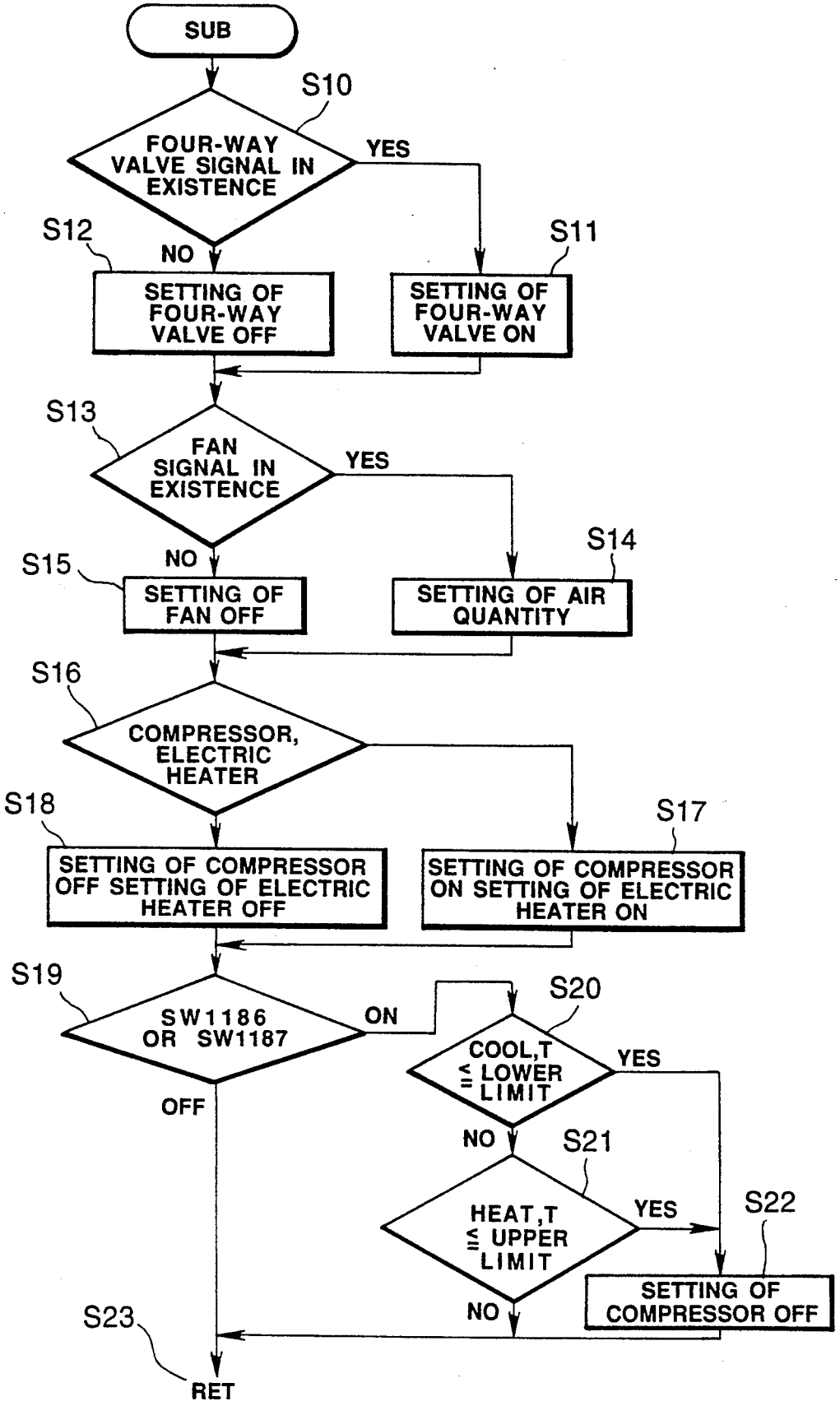
FIG. 12 is also a flow chart showing main operations of the air conditioner shown in FIG. 5.

FIG. 11 and FIG. 12 are flow charts showing principal operations of the microprocessor 250 shown in FIG. 6 and FIG. 7. Step S1 is a step to be performed after the buildup of the microprocessor 250, and in the step, setting states of respective setting switches are input and stored in a storage area by performing key scan. Next, in step S2, it is judged that the contact arm 1183*a* of the switch 1183 is on side R (REM: remote controller) (a valid state) or on side N (an invalid state) based on the scan results stored in the storage area, and when the contact arm is on side REM, the process is advanced to SUB in step S3 (flow chart shown in FIG. 12)

In step S4, the temperature of the indoor side heat exchanger 207, the room temperature T, the open air temperature, and the temperature of outdoor side heat exchanger 214 are measured using the temperature sensors 241 to 244, and the data are A/D converted and stored in the storage area.

In step S5, it is judged that the switches 1186 and 1187 are in ON states or not, and when either of the switches 1186 or 1187 is in the ON state, the process is advanced to step S6. In step S6, when the switch 1186 is ON and the operation mode is in the cooling mode (when the setting of the switch 1171 is COOL), the value of the set temperature is corrected based on the setting of the setting switch 1184, and when the switch 1187 is ON and the operation mode is in the heating mode, the value of set temperature is corrected based on the setting of the setting switch 1185.

In step S7, the ON/OFF of the compressor 213 is set in the storage area based on the comparison between the set temperature and the room temperature T (For the switching of ON and OFF a specified differential is set.); a draft quantity set by the switch 1170 is set in a storage area (When the switch is set at AUTO, LOW or HIGH is automatically set based on temperature difference between the set temperature and the room temperature T.); when the switch 1171 is set at HEAT (the heating mode), the ON of the four-way valve is set in the storage area; when the switch is set at COOL, or in the defrosting operation, the OFF of the four-way valve is set in the storage area; and in the heating mode, when the room temperature T is lower than set temperature by the specified value, or the open air temperature is low, ON of the four-way valve is set in the storage area.

In step S8, an abnormal state of the air conditioner or of the other equipment (such as an abnormal temperature of the indoor side heat exchanger 207 or of the outdoor side heat exchanger 214) is judged, and the necessary protective measures are taken.

In step S9, the operation of each equipment is controlled based on the ON/OFF set in the storage area.

Therefore, the operation of the compressor 213, etc. are controlled based on the air conditioning conditions set in the first setting portion 224.

FIG. 12 is a flow chart showing the details of step S3 shown in FIG. 11. In step S10 at first, it is judged whether the four-way valve signal is being output or not. The four-way valve signal (+24 V) is output from the terminal B of the connector 227 and in the AND gate 1151 it is changed to a scan output synchronizing with a scan signal and given to the terminal K4 of the microprocessor 250. The scan is performed at the same terminal as that of the HEAT setting scan of the switch 1171, however, they are discriminated by the state of the switch 1183. When there is a four-way valve signal, the process is advanced to step S11 and the ON of the four-way valve is set in a storage area, and when there is no four-way valve signal, the process is advanced to step S12 and the OFF of the four-way valve is set in a storage area.

In step S13, in a similar way, when a FAN signal (+24 V) is output to the terminal G of the connector 227, the process is advanced to step S 14, and a similar operation to the setting of draft quantity of the FAN which is performed in step S7 shown in FIG. 11 is performed and the setting of the draft quantity is performed in the storage area.

In step S15, the stop of FAN (the cross flow fan 208) is set in a storage area.

In step S16, in a similar way, it is judged that whether the ON signal of the compressor 213 (+24 V) and the ON signals (+24 V) of electric heaters 210 to 212 are output to the terminals Y and W of the connector 227 or not. Steps S17 and S18 are executed according to the existence or nonexistence of signals, and when there is a compressor signal, the ON of the compressor 213 is set, and when there is no compressor signal the OFF of the compressor 213 is set; when there is an electric heater signal, the ON of electric heaters 210 to 212 are set, and when there is no electric heater signal, the OFF of the electric heaters are respectively set in storage areas.

Next, in step S19, the ON/OFF of switches 1186 and 1187 are judged, and when the conditions of step S19 is satisfied, the process is advanced to steps S20 and S21, and when the room temperature T is lower than the lower limit (a lower limit set value set by the switch 1185) in a cooling mode, and when the room temperature T is higher than the upper limit (an upper limit set value set by the switch 1185) in a heating mode, the process is advanced to step S22, and the OFF of the compressor 213 is set in a storage area. In other words, when the room temperature is between the upper limit and the lower limit, it is possible to set the ON of the compressor 213 in a storage area.

Next, the process is advanced to step S8 shown in FIG. 11 through step S23.

In performing the operations as mentioned in the above, when the switch 1183 is set on the remote controller side (a valid state), the operation of each equipment is controlled by the ON signal of the compressor 213, the ON signal of FAN (cross flow fan), the ON signals of electric heaters 210 to 212 or the ON signal of the four-way valve output from the remote controller; however, the setting of the draft quantity of the FAN 208 is performed based on the setting of the setting switch 1170, and the upper limit and the lower limit of the temperature setting value are set by the setting switches 1184 and 1185.

As described in the above, according to the present invention, it is made possible to select the control of operation of the air conditioner either on the air conditioner side or on the remote controller side only by operating a changeover switch.

When the air conditioner is to be installed in the room to be air conditioned where the remote controller is already installed, in particular, it is easy to make it possible to control the operation of the air conditioner only by connecting the remote controller to a connector and operating a changeover switch.

According to the present invention, about the protective operation of the equipment or the operating conditions which are not set by a remote controller, control is made based on the setting of the first setting portion provided in the air conditioner, so that air conditioning operation can be performed based on the setting by the remote controller without losing the higher order function originally provided in the air conditioner.

It is further understood by those skilled in the art that the foregoing description is a preferred embodiment of the disclosed device and that various changes and modifications may be made in the invention without departing from the spirit and scope thereof.

What is claimed is:

1. An air conditioner being possessed of a refrigerating cycle using a compressor, a condenser, a expansion device and an evaporator comprising:

a first temperature sensing means for detecting the temperature of a room to be air conditioned, a first temperature setting means for setting a desired temperature, and a controlling means for controlling the operation of said compressor in order to make a detected temperature by said first temperature sensing means approach to said desired temperature set by said first temperature setting means;

said control means comprising:

a changeover switch, and a means for controlling said compressor based on a signal from a remote controller when said changeover switch is in a valid state;

said remote controller being disposed in a detached place from said air conditioner, being constituted to be able to transmit a signal to said control means, and further comprising:

a second temperature sensing means for detecting said room temperature, a second temperature setting means for setting a desired temperature, and a means for transmitting a signal for controlling said compressor to said control means to make the temperature detected by said second temperature sensing means approach to said desired temperature set by said second temperature setting means.

2. An air conditioner described in claim 1 wherein:

the control means comprises:

a first switch means for energizing the compressor, a first comparator means for comparing the values of the detected temperature detected by the first temperature sensing means and a desired temperature set by the first temperature setting means, a first switch control means for operating said first switch means corresponding to the comparison result by said first comparator means, and a means for making the activity of said first switch control means invalid while the changeover switch is valid and for operating said first switch means corresponding to the signal from the remote controller;

the remote controller comprises:

a second comparator means for comparing the values of the detected temperature detected by the second temperature sensing means and a desired temperature set by the second temperature setting means, and a means for transmitting a signal corresponding to the comparison result by the second comparator means to said control means.

3. An air conditioner described in claim 2 wherein:

the air conditioner comprises:

a drafting device for performing drafting operation for a room;

the control means comprises:

a second switch means for energizing said drafting device, a second switch control means for operating said second switch means interlocking with the ON/-OFF of the compressor operation, and a means for making the activity of said second switch control means invalid when the changeover switch is in a valid state and for operating said second relay means corresponding to a signal for the drafting device from the remote controller; and the remote controller comprises:

a means for generating a signal for said drafting device corresponding to the comparison result of the second comparator means, and a means for transmitting the signal for said drafting device to said control means.

4. An air conditioner described in claim 1 wherein:

the control means comprises:

a first switch means for energizing the compressor, a means for detecting the states of said equipment for judging an abnormal state of the equipment constituting said air conditioner, and a microprocessor inputting a detected temperature detected by a first temperature sensing means, a desired temperature set by a first temperature setting means, and a detected values of a detection means to detect the states of said equipment, and operating said first switch means based on these input data;

said microprocessor comprises:

a means for controlling the operation of said first switch means corresponding to a signal from a remote controller and for controlling the operation of said compressor, and a means for performing protective operations for said equipment when said equipment is found to be in an abnormal state based on the detected value obtained by the detection means for detecting the states of said equipment.

5. An air conditioner described in claim 4 wherein:

the air conditioner comprises:

a drafting device for performing the drafting operation for a room;

the control means comprises:

the second switch means for energizing said drafting device;

the remote controller comprises:

a second comparator means for comparing the relative values of the temperature detected by the second temperature sensing means and the desired temperature set by the second temperature setting means, a means for generating a signal for the drafting device corresponding to the comparison result of the second comparator means, and a means for transmitting a signal for said drafting device to said control means; and the microprocessor comprises:

a means for inputting a temperature detected by the first temperature sensing means, a desired temperature set by the first temperature setting means and a detected values detected by the means for detecting the states of said equipment and for operating said second switch means based on these input data, and a means for controlling the operation of the second switch means corresponding to a signal for said drafting device from the remote controller when the changeover switch is in a valid state to control the operation of said drafting device 6. An air conditioner described in claim 1 wherein:

the control means comprises:

a first switch means for energizing the compressor, a microprocessor for judging the relative values of the temperature detected by the first temperature sensing means and the set temperature and for operating said first switch means based on the judging result, and a regulation switch;

said microprocessor comprises:

a means for correcting a desired temperature set by the first temperature setting means to be in a predetermined temperature range and making the corrected temperature a set temperature when said regulation switch is in a valid state, a means for setting a desired temperature by said first temperature setting means a set temperature when said regulation switch is in a invalid state, and a means for operating said first switch means based on a signal from the remote controller when said judgment result is going to energize said compressor in making said first relay means operate while the changeover switch is in a valid state and also the regulation switch is in a valid state.

7. An air conditioner being possessed of a refrigerating cycle using a compressor, a condenser, a expansion device, and said air conditioner comprising:

a first temperature sensing means for detecting the temperature of a room to be air conditioned, a first temperature setting means for setting a desired temperature, and a control means for controlling the operation of said compressor to make the temperature detected by said first temperature sensing means approach to the desired temperature; and further said air conditioner comprising:

a second temperature sensing means for detecting the temperature in said room, a second temperature setting means for setting a desired temperature being disposed in a detached place from the air conditioner, and a constitution to be able to connect a remote controller constituted to have a means to transmit a signal for controlling the compressor to make the temperature detected by the second temperature sensing means approach to the desired temperature set by the second temperature setting means to the control means; and the control means comprises:

a changeover switch, and a means for controlling the compressor based on a signal from said remote controller when the changeover switch is in a valid state.

* * * * *